US009279580B2

(12) United States Patent
Jargiello, III

(10) Patent No.: US 9,279,580 B2
(45) Date of Patent: Mar. 8, 2016

(54) PERCUSSION-TRIGGERED LIGHTING SYSTEM

(71) Applicant: Frank E. Jargiello, III, Scranton, PA (US)

(72) Inventor: Frank E. Jargiello, III, Scranton, PA (US)

( * ) Notice: Subject to any disclaimer, the term of this patent is extended or adjusted under 35 U.S.C. 154(b) by 326 days.

(21) Appl. No.: 13/936,103

(22) Filed: Jul. 5, 2013

(65) Prior Publication Data

US 2015/0009417 A1 Jan. 8, 2015

(51) Int. Cl.

| | |
|---|---|
| ***F21V 33/00*** | (2006.01) |
| ***G10D 13/02*** | (2006.01) |
| *F21Y 101/02* | (2006.01) |

(52) U.S. Cl.

CPC ..... *F21V 33/0056* (2013.01); *G10D 13/02* (2013.01); *F21Y 2101/02* (2013.01)

(58) Field of Classification Search

CPC . F21V 33/0056; F21Y 2101/02; G10D 13/02; A63J 17/00

USPC ..... 84/411 R, 422.1

See application file for complete search history.

(56) References Cited

U.S. PATENT DOCUMENTS

| | | | | |
|---|---|---|---|---|
| 3,346,732 | A | 10/1967 | Crusius | |
| 3,869,699 | A | 3/1975 | Haller et al. | |
| 4,353,008 | A | 10/1982 | Dorfman | |
| 5,136,487 | A | 8/1992 | Schmidt | |
| 5,280,742 | A | 1/1994 | Vergara | |
| 5,509,343 | A | 4/1996 | Hsu | |
| 5,922,981 | A | 7/1999 | Ballister | |
| 6,586,666 | B2 | 7/2003 | Abe | |
| 6,815,602 | B2 | 11/2004 | De Franco | |
| 7,227,075 | B2 | 6/2007 | Chang et al. | |
| 2006/0174749 | A1 * | 8/2006 | Lerner | 84/419 |

OTHER PUBLICATIONS

Website, http://www.drumnova.com/main.html, Drumstrobe Pro triggered drum illumination, one sheet printed from the internet on Apr. 4, 2012.

Website, http://spaundrums.com/shop/index.php/drumkits/led-kits.html, series of lighted drum kits, two sheets printed from the internet on Apr. 4, 2012.

* cited by examiner

*Primary Examiner* — William C Dowling
*Assistant Examiner* — Ryan Howard
(74) *Attorney, Agent, or Firm* — Richard C. Litman

(57) ABSTRACT

The percussion-triggered lighting system is adapted to provide steady and/or percussively triggered illumination within one or more drums. The drums have translucent heads to allow the internal lighting to be viewed. An electromechanical switch is installed within the drum(s), for economy and to allow the system to be installed in existing drums. The system may also operate small peripheral lights around the edge of one or more drums, the peripheral lighting being programmable to produce various moving patterns. The system may also include a video projector within one or more drums to project a visual image on the interior of the translucent drum head that is visible to the audience. A separate control panel may be provided to allow the drummer to actuate any of the percussive lights without striking the drum to avoid creating a sound when a drum beat is inappropriate during the performance.

19 Claims, 3 Drawing Sheets

PERCUSSION-TRIGGERED LIGHTING SYSTEM

BACKGROUND OF THE INVENTION

1. Field of the Invention

The present invention relates generally to lighting systems for live stage performances, and particularly to a percussion-triggered lighting system actuated by a drum kit or other percussion instrument during a musical performance.

2. Description of the Related Art

It has long been recognized that most musical performances include visual elements as well. Perhaps this is most true in the field of popular music, e.g., rock music and its various related genres. Accordingly, many musicians and bands have attempted to provide more spectacular visual elements and showmanship in order to provide not only a musical show, but a visual show as well.

Initially, such visual elements tended to be limited to the stage settings and the attire and actions of the performers. However, some musicians and performers also realized that the visual effects of their musical performances could be further enhanced by embellishing their musical instruments in some manner. In addition to constructing many of their instruments (guitars being a prime example) to have a spectacular and eye-catching appearance, some musicians and performers developed the concept of illuminating certain instruments in some manner.

The instruments that lend themselves best to such illumination are percussion instruments, and particularly drums. Drums by their nature have open, empty interiors, lending themselves to the installation of various lighting means therein. Constructing a drum to have a translucent drum head allows such interior lighting to project through the drum head to add another attractive visual effect to the musical performance and show. A further development was to construct some form of triggering device that would only illuminate the drum when the drum was struck, i.e., produced a drum beat. The synchronization of a light pulse with the sound pulse of the drum beat created an additional entertainment factor to please the audience.

However, the electronic systems developed in the past to actuate a lighting system by a percussive beat to a drum tend to be relatively costly, and generally must be original equipment manufactured into the drum. They generally cannot readily be added to the drum after the drum has been completed. Moreover, they only illuminate the interior of the drum. No illumination is provided on the exterior shell of the drum or in other areas of the stage or setting. In addition, percussively triggered lighting systems require that the drum be struck, thereby producing a sharp sound. In many instances it may not be appropriate to play the drums during certain passages, yet synchronized illumination of the interior(s) and exterior(s) of the drum(s) and/or other areas of the stage setting may be desirable to enhance the visual effects as other instruments are being played.

Thus, a percussion-triggered lighting system solving the aforementioned problems is desired.

SUMMARY OF THE INVENTION

The percussion-triggered lighting system includes various internal and external lighting elements for a drum kit, the kit including at least one bass drum, at least one intermediate ("tom-tom") drum, and at least one snare drum. Any or all of the drums may include a steady light therein adapted to remain illuminated independently of percussion of the drum.

Any or all of the drums may further include a light and switch mechanism to illuminate the light only when the drum is struck. In addition, at least one of the drums, e.g., the bass drum, may be equipped with peripheral lighting and controls that cause the peripheral lighting to vary around the perimeter of the drum, e.g., to appear to rotate, strobe, flash, etc.

The above percussively triggered lighting elements are only illuminated when the corresponding drum(s) is struck, thereby producing a sharp sound. The percussion triggered lighting system further includes an auxiliary percussive control panel, enabling the drummer to strike one or more of the pads of the panel to illuminate one or more corresponding lighting elements in or on the drums without producing a corresponding sound. The brightness of any or all of the lighting elements may be controlled as desired by a separate dimmer control panel.

In addition to the above, one or more of the drums (e.g., the bass drum or drums) may have a video projector installed therein to project a visual image on the interior of the translucent drum head to be visible to the audience. The visual image may be a prerecorded natural, synthetic, or abstract still or moving scene, or a close-up view of one or more of the musicians as they play, or views of the audience if a suitable camera is provided. Moreover, the percussion-triggered lighting system may be used to operate external lighting, i.e., lighting removed from the drums themselves.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The percussion-triggered lighting system provides a number of internal and external lights for drums, which are constantly lighted or are lighted upon percussion of the drum(s). Various other lighting systems and controls may be provided for the momentary illumination of the lights without percussion of the drum(s), and/or other lighting remote from the drum(s), drummer, and controls. The system may also be used to control a video projector disposed within one or more of the drums. The system may be retrofit to an existing drum kit as an after-market improvement.

Figure 1:
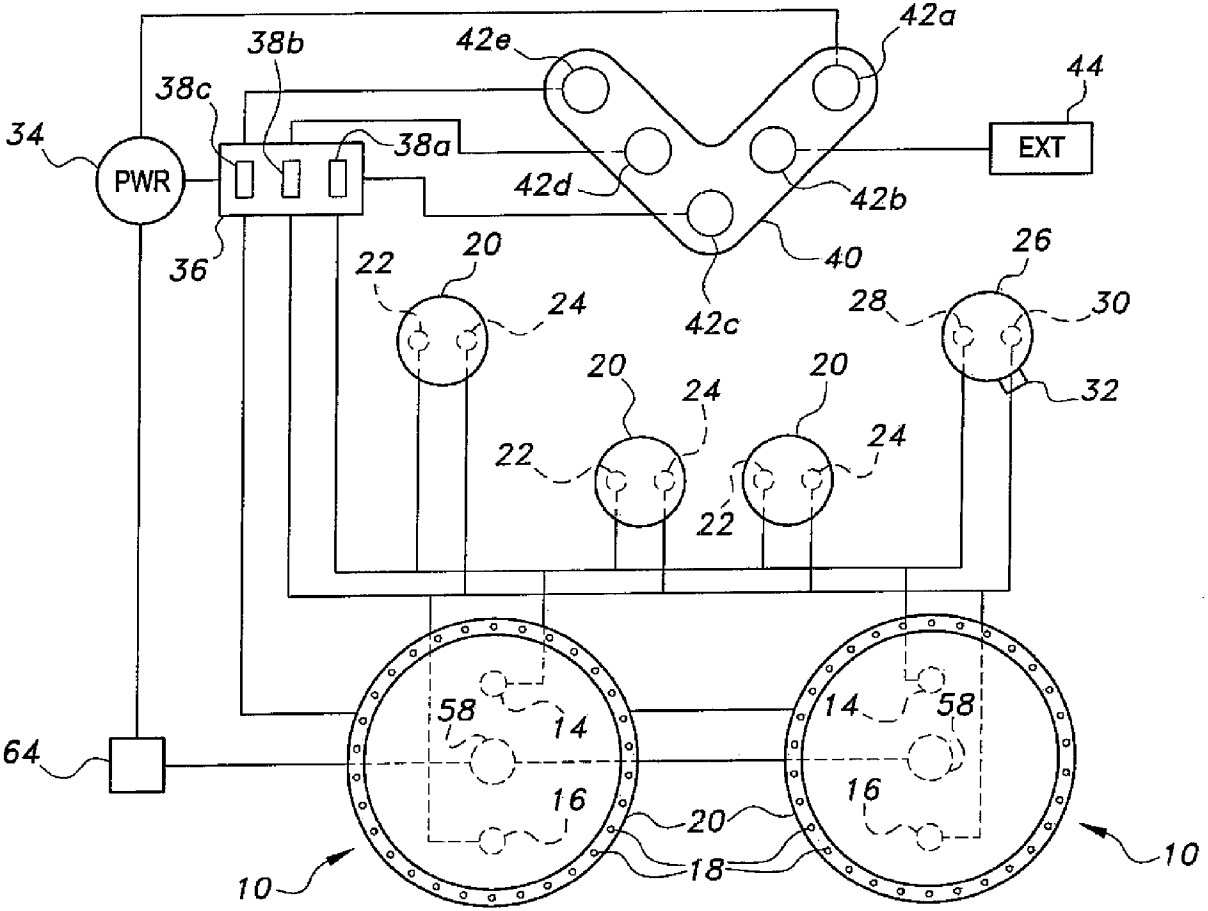
FIG. 1 is a schematic diagram of a percussion-triggered lighting system according to the present invention, illustrating its basic components and their relationships.

FIG. 1 of the drawings provides a schematic illustration of the basic percussion triggered lighting system of the present invention. In FIG. 1, two bass drums 10 are provided. Each of the drums has a translucent drum head 12 (shown in FIG. 2B)

in order to allow light to pass from the interior of the drums through the drum head for viewing external to the drum. Each of the drums has a steady light 14 disposed therein, i.e., a light that is illuminated continuously throughout the performance, rather than being controlled by percussion of the drums. Each of the drums 10 further has a percussion activated or controlled light 16 therein. The internal drum lights 14 and 16 may be any desired type of lighting, e.g., incandescent, fluorescent, etc., but are preferably light emitting diodes (LEDs) due to their durability and rapid response time for use as a percussively activated light. While the schematic drawing of FIG. 1 illustrates both steady and percussively illuminated lights 14 and 16 within each of the drums 10, it will be seen that either or both types of lighting may be installed in either or both bass drums 10, as desired. Each of the bass drums 10 may also include one or more strings of percussion-triggered external lights 18 disposed circumferentially about their rims 20. The peripheral external lights 18 may be actuated to illuminate in any of various predetermined sequences, e.g., in consecutive sequence around the string or strings to produce the appearance of rotation, alternating illumination, etc., as desired.

The percussion-triggered lighting system may further include at least one, and preferably a small number of intermediate drums 20, known as "tom-toms." The drum heads of the tom-toms 20 are also made of a translucent material in the manner of the translucent drum heads of the bass drums 10. The tom-toms 20 may also include steady illumination sources 22 therein, as well as percussively actuated lights 24, similarly to the respective lights 14 and 16 of the bass drums 10. A snare drum 26 may also be included in the drum kit. The snare drum also contains a steady light 28 and a percussively controlled light 30 therein. As the beat of a snare drum is of relatively short duration, a timer delay switch 32 may be provided to delay the opening of the actuation switch for the percussively actuated light 30 for a short time, e.g., one half second or so, after a drum beat. The timer delay switch 32 may be adjusted to provide any practicable duration for the light 30.

Electrical power is provided for the above-described lighting system by a conventional electrical source 34, e.g., the a.c. power mains, a generator for remote locations, etc. Electrical power is received from the electrical power source 34 by a switch panel 36 that serves to distribute the electrical power to the various lights described further above. The switch panel 36 includes a first switch 38*a* that provides power to the steady lights 14, 22, and 28 of the corresponding drums 10, 20, and 26, a second switch 38*b* that provides power to the percussively actuated lights 16, 24, and 30 of those respective drums, and a third switch 38*c* that provides power to the peripheral lights 18 of the one or more bass drums 10. The switch panel 36 may comprise a dimmer control panel in which each of the switches 38*a* through 38*c* comprises a dimmer switch, if desired.

There may be times during the course of a performance that the actuation of the percussively controlled lights within the various drums may be desired, but no drum beat is desired at that particular point in the performance. The percussion-triggered lighting system provides for the actuation of the various drum lights without requiring a drum beat by a light switch array 40 located remotely from the various drums 10, 20, and 26. The term "remotely", in terms of the location of the light switch array 40, means that the array 40 is not necessarily attached to any of the drums, but is within convenient reach of the drummer during the performance. The light switch array 40 includes a number of percussion actuated switches 42*a* through 42*e*. Each of the switches 42*a*-42*e* controls some function of the various lights of the system. Each of the switches 42*a* through 42*e* comprises a relatively soft pad with a contact switch or touch switch therein, so that a strike of the pad of the switch produces nearly no sound due to the acoustic properties of the pad. The sound of a strike upon any of the switches 42*a* through 42*e* cannot be heard by the audience due to the overall sound of the musical performance while playing.

A first switch 42*a* may serve as a master power switch for the system, receiving electrical power from the power source 34. A second switch 42*b* may serve to provide electrical power to some external lighting array 44 located remotely from the drums, e.g., stage lighting, etc. A third switch 42*c* may control electrical power to the switch 38*a* of the switch panel 36, thereby controlling the power to the steady lights steady lights 14, 22, and 28 of the corresponding drums 10, 20, and 26. A fourth switch 42*d* may control electrical power to the second switch 38*b* of the switch panel 36, thereby controlling power to the percussively actuated lights 16, 24, and 30 of those respective drums. A fifth switch 42*e* may control electrical power to the third switch 38*c* of the switch panel 36, thereby controlling power to the peripheral lights 18 of the one or more bass drums 10. The above-described light switch array 40 and the various switches 42*a* through 42*e* are exemplary, and the number, arrangement, and functions of the various switches may be adjusted as desired.

Figure 2B:
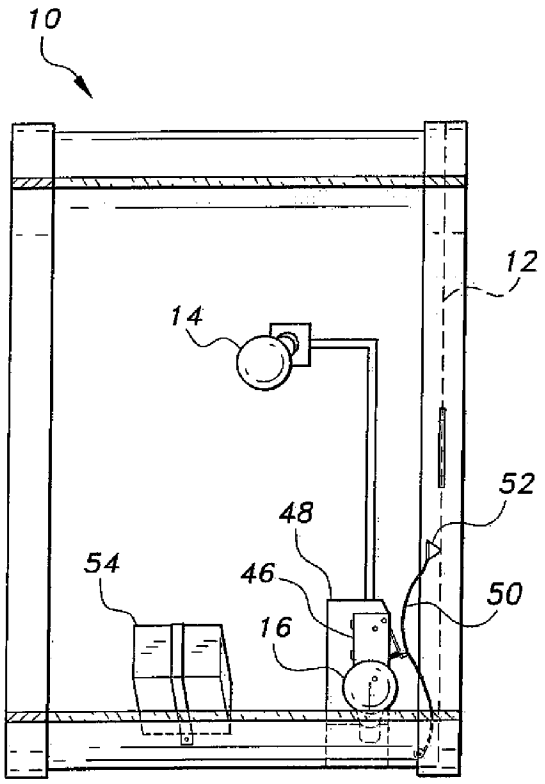
FIG. 2B is a side elevation view in section along lines 2B-2B of FIG. 2A.
Figure 2A:
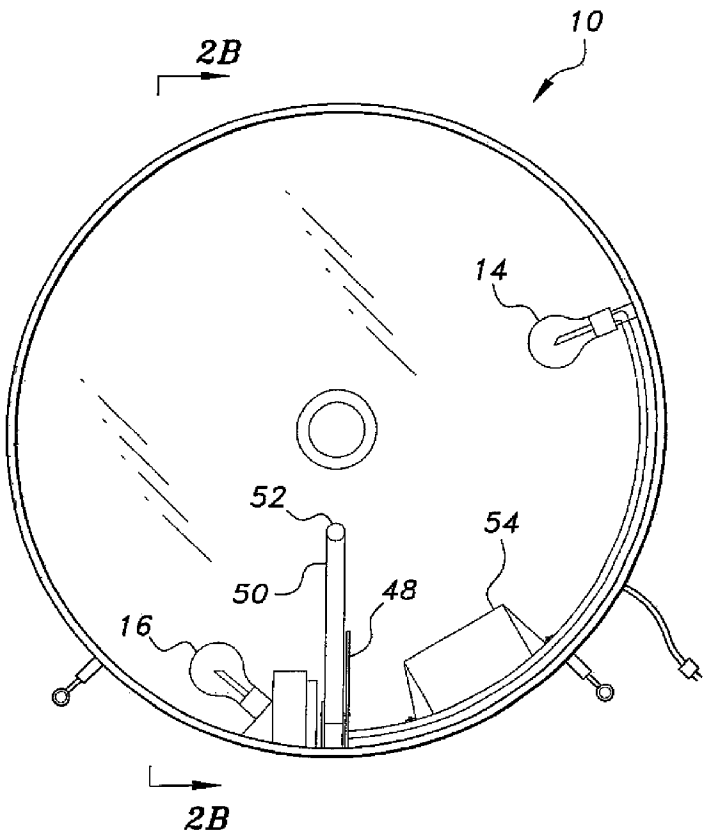
FIG. 2A is a diagrammatic front elevation view in section of a bass drum of the percussion-triggered lighting system according to the present invention, illustrating its internal components.

At least some of the various lights of the various drums are controlled by percussive strikes of the various drums, as described further above. The switches for illuminating the associated lights due to drum strikes or beats are located within the respective drums. FIGS. 2A and 2B of the drawings provide internal views of an exemplary bass drum 10. It will be understood that percussively actuated lights disposed within the tom-tom drums 20 and/or snare drum 26 use essentially the same switch configuration. The switch mechanism illustrated in FIGS. 2A and 2B includes an electromechanical microswitch 46 (shown in FIG. 2B) installed within the drum 10 on a mounting bracket 48, and an actuator arm 50 extending from a pivot point at the base of the bracket and/or microswitch 46 to a resilient contact bumper 52 at the distal end of the arm 50. FIGS. 2A and 2B also show a ballast weight 54 installed within the drum 10 to stabilize the drum kit and its attached tom-toms and other attached equipment (e.g., cymbals, etc.). The electromechanical switch assembly operates when the drum 10 is struck, so that the drum head 12 flexes and reverberates inward and outward, accordingly. The moving drum head 12 transfers motion to the contact bumper 52 of the actuator arm 50, thus causing the actuator arm 50 to move and transfer its motion to the microswitch 46 by means of its switch contact. The opening and closing of the microswitch 46 causes the percussion-triggered light 16 within the drum 10 to illuminate momentarily. The same switch assembly may also communicate electrically with the external lights 18 installed peripherally about the rim 20 of the drum 10 (and/or other drums, if so desired).

Figure 3B:
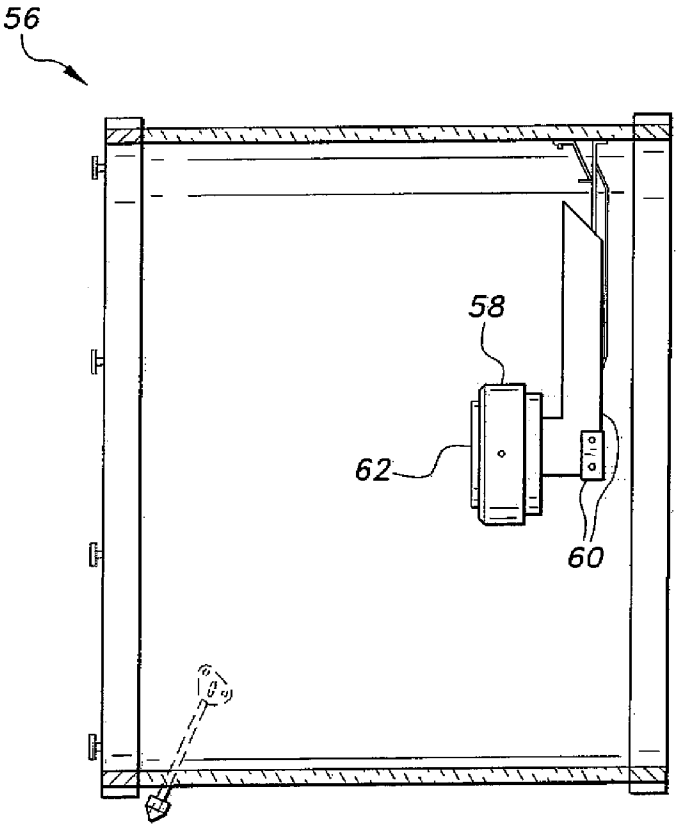
FIG. 3B is a side elevation view in section along lines 3B-3B of FIG. 3A.
Figure 3A:
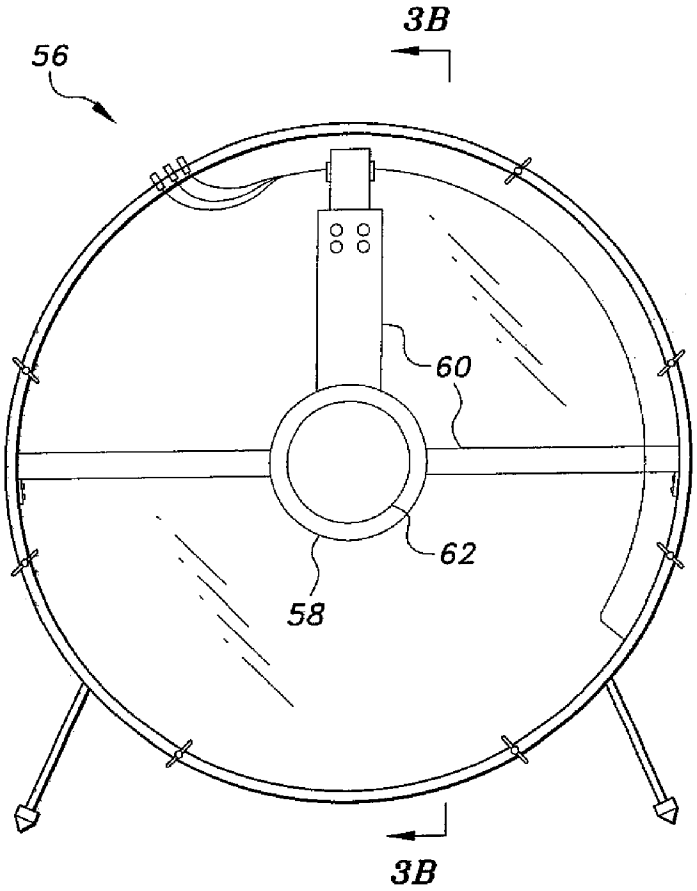
FIG. 3A is a diagrammatic front elevation view in section of a bass drum of the percussion triggered lighting system according to the present invention, illustrating alternative internal components comprising a video projection system.

FIGS. 3A and 3B illustrate another embodiment of the percussion-triggered lighting system in which a video projector is installed within a drum 56. The drum 56 may be a bass drum similar to the bass drums 10 of FIGS. 1 through 2B, or other desired drum type. Rather than having various percussion-actuated and steady lighting within the drum 56, a video projector 58 is installed therein on a bracket 60. The projector 58 has a lens 62 adjusted to project an in-focus image on the inside of the translucent drum head, and receives electrical power and video signal from a projector control system 64 (shown in FIG. 1) disposed external to the drum 56. The projector 58 may also be electrically connected to a percussively actuated microswitch, such as the microswitch 46 and contact arm 50 illustrated in the drum 10 of FIG. 2, to actuate or deactivate the video display, and/or to switch the display to different displays, if desired. One or more conventional video cameras (not shown) may be set up to receive video images of one or more of the performers, scenes of the audience, and/or other scenes, so that the drummer or other personnel (e.g., a lighting technician) may switch the scene(s) as desired during the course of the performance. Alternatively, the video projection system may be installed within one or more of the bass drums 10 in addition to the steady and percussively actuated lights 14 and 16, as indicated in broken lines in FIG. 1.

It is to be understood that the present invention is not limited to the embodiments described above, but encompasses any and all embodiments within the scope of the following claims.

I claim:

1. A percussion-triggered lighting system, comprising:

a drum having a translucent head;

at least one selectively operable steady light disposed within the drum, the steady light being adapted to transmit light through the translucent drum head, the steady light being operable independently of drum actuation;

at least one percussion-triggered light disposed within the drum, the percussion triggered light being adapted to transmit light through the translucent drum head, the percussion triggered light being operable due to percussion of the drum;

a light switch array remotely disposed from the drum, the light switch array communicating electrically with at least the percussion-triggered light within the drum; and an electromechanical switch disposed within the drum head, the electromechanical switch communicating electrically with the percussion-triggered light, the electromechanical switch having an actuator arm in contact with the drum head, the actuator arm actuating the electromechanical switch to illuminate the percussion-triggered light when the drum head is struck.

2. The percussion triggered lighting system according to claim 1, further comprising:

a video projector disposed within the drum, the video projector having a projection lens oriented toward the drum head; and a projector control system disposed external to the drum, the projector control system and the electromechanical switch communicating electronically with the video projector within the drum, the actuator arm actuating the electromechanical switch to turn on the video projector when the drum head is struck.

3. The percussion triggered lighting system according to claim 1, wherein the drum has a peripheral rim surrounding the head, the system further comprising at least one percussion-triggered external light disposed upon the rim, the percussion-triggered external light being operable due to percussion of the drum, the electromechanical switch communicating electrically with the percussion-triggered external light, the actuator arm actuating the electromechanical switch to illuminate the percussion-triggered external light when the drum head is struck.

4. The percussion-triggered lighting system according to claim 1, further comprising at least one remotely disposed light communicating electrically with the light switch array, the remotely disposed light being disposed external to the drum and separated therefrom.

5. The percussion-triggered lighting system according to claim 1, further comprising a timer delay switch disposed on the drum, the timer delay switch communicating electrically with the percussion-triggered light, the timer delay switch being adapted to extend the period of illumination of the percussion-triggered light after the drum head is struck.

6. The percussion triggered lighting system according to claim 1, further comprising a dimmer control panel communicating electrically with at least the steady light and the percussion-triggered light.

7. A percussion-triggered lighting system, comprising:

a drum having a translucent head;

a video projector disposed within the drum, the video projector having a projection lens oriented toward the drum head;

a projector control system disposed external to the drum, the projector control system communicating electronically with the video projector within the drum; and an electromechanical switch disposed within the drum head, the electromechanical switch communicating electrically with the video projector, the electromechanical switch having an actuator arm in contact with the drum head, the actuator arm actuating the electromechanical switch to turn on the video projector when the drum head is struck.

8. The percussion triggered lighting system according to claim 7, further comprising:

at least one selectively operable steady light disposed within the drum, the steady light being adapted to transmit light through the translucent drum head, the steady light being operable independently of drum actuation; and at least one percussion-triggered light disposed within the drum, the percussion triggered light being adapted to transmit light through the translucent drum head, the percussion triggered light being operable due to percussion of the drum, the actuator arm actuating the electromechanical switch to illuminate the percussion-triggered light when the drum head is struck.

9. The percussion-triggered lighting system according to claim 7, wherein the drum has a peripheral rim surrounding the head, the system further comprising at least one percussion-triggered external light disposed upon the rim, the percussion-triggered external light being operable due to percussion of the drum, the electromechanical switch communicating electrically with the percussion-triggered external light, the actuator arm actuating the electromechanical switch to illuminate the percussion-triggered external light when the drum head is struck.

10. The percussion-triggered lighting system according to claim 7, further comprising a light switch array remotely disposed from the drum, the light switch array communicating electrically with at least the percussion-triggered light within the drum.

11. The percussion-triggered lighting system according to claim 10, further comprising at least one remotely disposed light communicating electrically with the light switch array, the remotely disposed light being disposed external to the drum and separated therefrom.

12. The percussion-triggered lighting system according to claim 7, further comprising a timer delay switch disposed on the drum, the timer delay switch communicating electrically with the percussion-triggered light, the timer delay switch being adapted to extend the period of illumination of the percussion-triggered light after the drum head is struck.

13. The percussion-triggered lighting system according to claim 7, further comprising a dimmer control panel communicating electrically with at least the steady light and the percussion triggered light.

14. A percussion-triggered lighting system, comprising:

a drum having a translucent head and a peripheral rim surrounding the head;

at least one percussion-triggered external light disposed upon the rim, the percussion-triggered external light being operable due to percussion of the drum; and an electromechanical switch disposed within the drum head, the electromechanical switch communicating electrically with the percussion-triggered external light, the electromechanical switch having an actuator arm in contact with the drum head, the actuator arm actuating the electromechanical switch to illuminate the percussion-triggered external light when the drum head is struck.

15. The percussion-triggered lighting system according to claim 14, further comprising:

at least one selectively operable steady light disposed within the drum, the steady light being adapted to transmit light through the translucent drum head, the steady light being operable independently of drum actuation; and at least one percussion-triggered light disposed within the drum, the percussion-triggered light being adapted to transmit light through the translucent drum head, the percussion-triggered light being operable due to percussion of the drum, the actuator arm actuating the electromechanical switch to illuminate the percussion-triggered light when the drum head is struck.

16. The percussion-triggered lighting system according to claim 14, further comprising:

a video projector disposed within the drum, the video projector having a projection lens oriented toward the drum head; and a projector control system disposed external to the drum, the projector control system and the electromechanical switch communicating electronically with the video projector within the drum, the actuator arm actuating the electromechanical switch to turn on the video projector when the drum head is struck.

17. The percussion-triggered lighting system according to claim 14, further comprising:

a light switch array remotely disposed from the drum, the light switch array communicating electrically with at least the percussion triggered light within the drum; and a dimmer control panel communicating electrically with at least the steady light and the percussion-triggered light.

18. The percussion triggered lighting system according to claim 17, further comprising at least one remotely disposed light communicating electrically with the light switch array, the remotely disposed light being disposed external to the drum and separated therefrom.

19. The percussion-triggered lighting system according to claim 14, further comprising a timer delay switch disposed on the drum, the timer delay switch communicating electrically with the percussion-triggered light, the timer delay switch being adapted to extend the period of illumination of the percussion-triggered light after the drum head is struck.

* * * * *